US007482978B2

(12) United States Patent
Yang et al.

(10) Patent No.: US 7,482,978 B2
(45) Date of Patent: Jan. 27, 2009

(54) PLANAR INVERTED-F ANTENNA

(75) Inventors: Mei-Chin Yang, Taipei (TW); Fu-Ren Hsiao, Taipei (TW); Tsung-Wen Chiu, Taipei (TW); Chin-Fan Chen, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/416,235

(22) Filed: May 3, 2006

(65) Prior Publication Data

US 2007/0035451 A1 Feb. 15, 2007

(30) Foreign Application Priority Data

Aug. 12, 2005 (TW) ..... 94127532 A

(51) Int. Cl.
*H01Q 1/38* (2006.01)

(52) U.S. Cl. ..... 343/700 MS; 343/702

(58) Field of Classification Search ..... 343/700 MS, 343/702, 767, 846

See application file for complete search history.

(56) References Cited

U.S. PATENT DOCUMENTS 6,448,932 B1 * 9/2002 Stoiljkovic et al. .... 343/700 MS
6,727,854 B2 4/2004 Fang et al.
6,741,214 B1 * 5/2004 Kadambi et al. ..... 343/700 MS
6,876,329 B2 * 4/2005 Milosavljevic ..... 343/700 MS
7,113,133 B2 * 9/2006 Chen et al. ..... 343/700 MS
7,183,980 B2 * 2/2007 Chang et al. ..... 343/700 MS
7,199,757 B2 * 4/2007 Tung ..... 343/700 MS
2003/0103010 A1 6/2003 Boyle

* cited by examiner

*Primary Examiner*—Tan Ho
(74) *Attorney, Agent, or Firm*—Troxell Law Office, PLLC

(57) ABSTRACT

A PIFA in one embodiment includes a radiating member including a feed point, a shorting point, a first radiating element having a starting point and a terminating point coiled as a longer path terminated at an outer edge of a ground plane and being open for generating a resonance mode having a low frequency, and a second radiating element having a starting point connected to the starting point of the first radiating element, and a terminating point extended to form a shorter path terminated at the outer edge of the ground plane, the terminating points of the first and second radiating elements adjacent for generating a resonance mode having a high frequency; low and high frequency medium frequency regulators for adjusting resonance frequencies of two different resonance modes a substrate; a feed member; and a shorting member.

6 Claims, 4 Drawing Sheets

PLANAR INVERTED-F ANTENNA

BACKGROUND OF THE INVENTION

1. Field of Invention

The present invention relates to planar inverted-F antennas (PIFAs) and more particularly to such a PIFA with improved characteristics.

2. Description of Related Art

Our daily life becomes much convenient as technology (particularly mobile communication technology) has known a rapid, spectacular development in recent several decades. For example, mobile phones are widely used. As to mobile phones, one trend is to develop more compact mobile phones. In this regard, an antenna of a mobile phone is typically formed as an internal, miniature one.

As to antenna mounted in a mobile communication device (e.g., PDA (Personal Digital Assistant), mobile phone, or the like), the antenna is typically implemented as a PIFA. For example, U.S. Pat. No. 6,727,854 B2 discloses a PIFA for mobile phone as shown in FIG. 1. The PIFA comprises a radiating device. Three current paths 10, 14, and 15 are formed in the radiating device and each starts at a feed point 17 and terminates at a ground point 16. A resonance is generated due to the multiple current paths. As a result, the PIFA is adapted to operate in two or more frequencies. U.S. Patent Publication No. 2003/0103010 A1 discloses a dual-band antenna arrangement for a mobile phone handset as shown in FIG. 2. In a patch conductor, two current paths 20 and 24 formed in the patch conductor and each starts at a feed pin 25 and terminates at a shorting pin 26. A resonance is generated due to the multiple current paths. As a result, the antenna is adapted to operate in two or more frequencies.

Multiple current paths are the characteristic of both prior art antenna arrangements. The multiple current paths are adapted to control an operating frequency of the antenna. Further, it is required to adjust a resonance frequency by changing size of a radiating member. It is understood that a resonance frequency of an antenna is partly affected by the environment. This is particularly true for an internal antenna such as one mounted in a mobile phone. As such, time spent on finalizing the specifications of an antenna is relatively long. This inevitably prolongs the development time of a mobile communication product (e.g., mobile phone). This is a disadvantage since more and more new types and models of mobile phone are available in an even faster pace. That is, the market is very competitive and product life is shortened greatly. Thus, the need for improvement still exists in order to overcome the inadequacies of the prior art.

SUMMARY OF THE INVENTION

It is therefore one object of the present invention to provide a PIFA comprising a ground plane; a radiating member including a feed point, a shorting point, a first radiating element having a first starting point proximate the feed point and the shorting point, and a first terminating point coiled as a longer path terminated at an outer edge of the ground plane and being open for generating a first resonance mode having a low frequency, and a second radiating element having a second starting point connected to the first starting point of the first radiating element, and a second terminating point extended toward the first terminating point of the first radiating element to form a shorter path terminated at the outer edge of the ground plane, the second terminating point of the second radiating element being proximate the first terminating point of the first radiating element for generating a second resonance mode having a high frequency; a low frequency medium frequency regulator located at the first terminating point of the first radiating element and being perpendicular to the ground plane for adjusting a resonance frequency of the first resonance mode having a low frequency; a high frequency medium frequency regulator located at the second terminating point of the second radiating element and being perpendicular to the ground plane for adjusting a resonance frequency of the second resonance mode having a high frequency; a substrate; a feed member having one end connected to the feed point of the radiating member and the other end connected to a signal source for signal transmission; and a shorting member having one end connected to the ground plane and the other end connected to the shorting point of the second radiating element.

It is another object of the present invention to provide a PIFA comprising a ground plane; a radiating member including a feed point, a shorting point, a first radiating element having a first starting point proximate the feed point and the shorting point, and a first terminating point coiled as a longer path terminated at an inner edge of the ground plane and being open for generating a first resonance mode having a low frequency, and a second radiating element having a second starting point connected to the first starting point of the first radiating element, and a second terminating point extended toward the first terminating point of the first radiating element to form a shorter path terminated at the inner edge of the ground plane, the second terminating point of the second radiating element being proximate the first terminating point of the first radiating element for generating a second resonance mode having a high frequency; a low frequency medium frequency regulator located at the first terminating point of the first radiating element and being perpendicular to the ground plane for adjusting a resonance frequency of the first resonance mode having a low frequency; a high frequency medium frequency regulator located at the second terminating point of the second radiating element and being perpendicular to the ground plane for adjusting a resonance frequency of the second resonance mode having a high frequency; a substrate; a feed member having one end connected to the feed point of the radiating member and the other end connected to a signal source for signal transmission; and a shorting member having one end connected to the ground plane and the other end connected to the shorting point of the second radiating element.

In one aspect of the present invention each of the low frequency medium frequency regulator and the high frequency medium frequency regulator has a dielectric constant in a range of 10 and 150.

In another aspect of the present invention the substrate is a microwave dielectric member.

In a further aspect of the present invention the first radiating element and the second radiating element are located at two different planes.

The above and other objects, features and advantages of the present invention will become apparent from the following detailed description taken with the accompanying drawings.

DETAILED DESCRIPTION OF THE INVENTION

Figure 1:
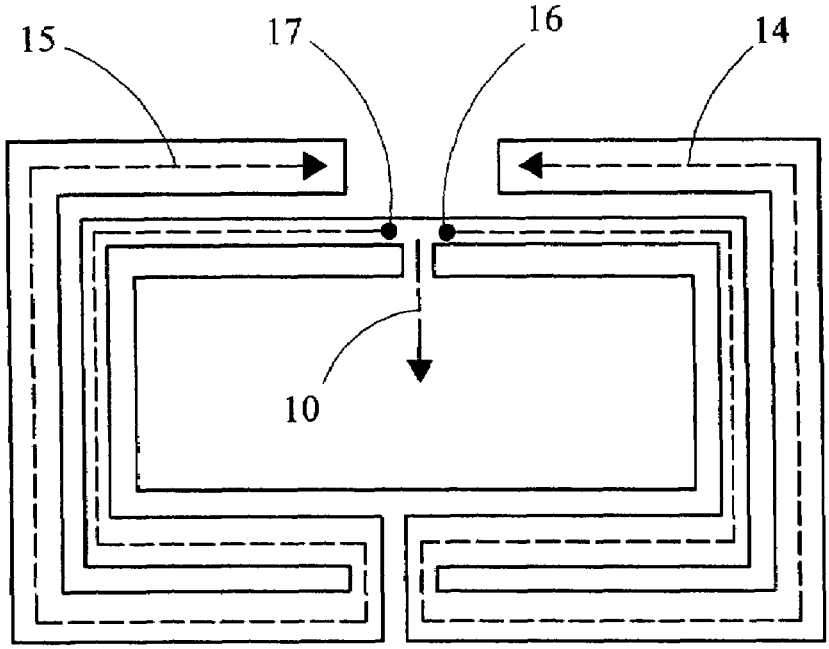
FIG. 1 PRIOR ART
FIG. 1 schematically depicts a conventional PIFA.
Figure 2:
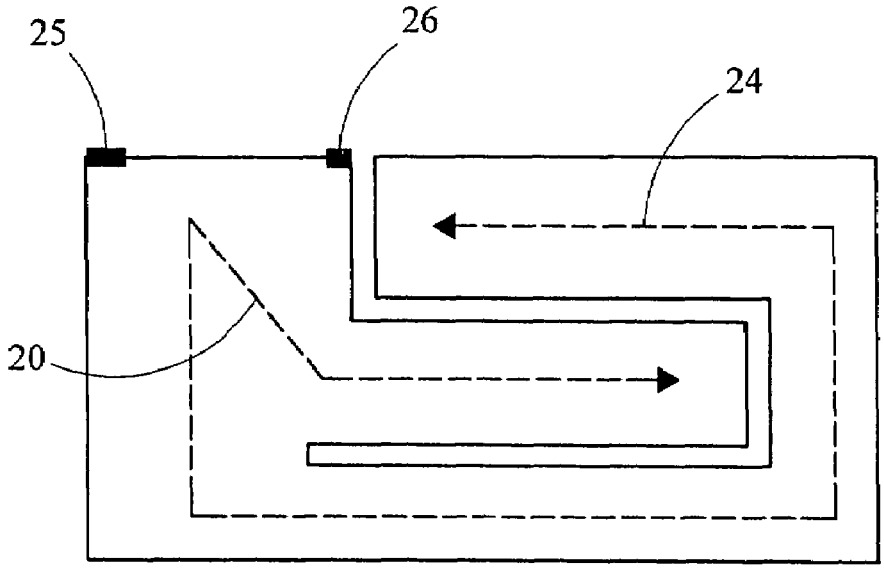
FIG. 2 PRIOR ART
FIG. 2 schematically depicts another conventional PIFA.
Figure 3:
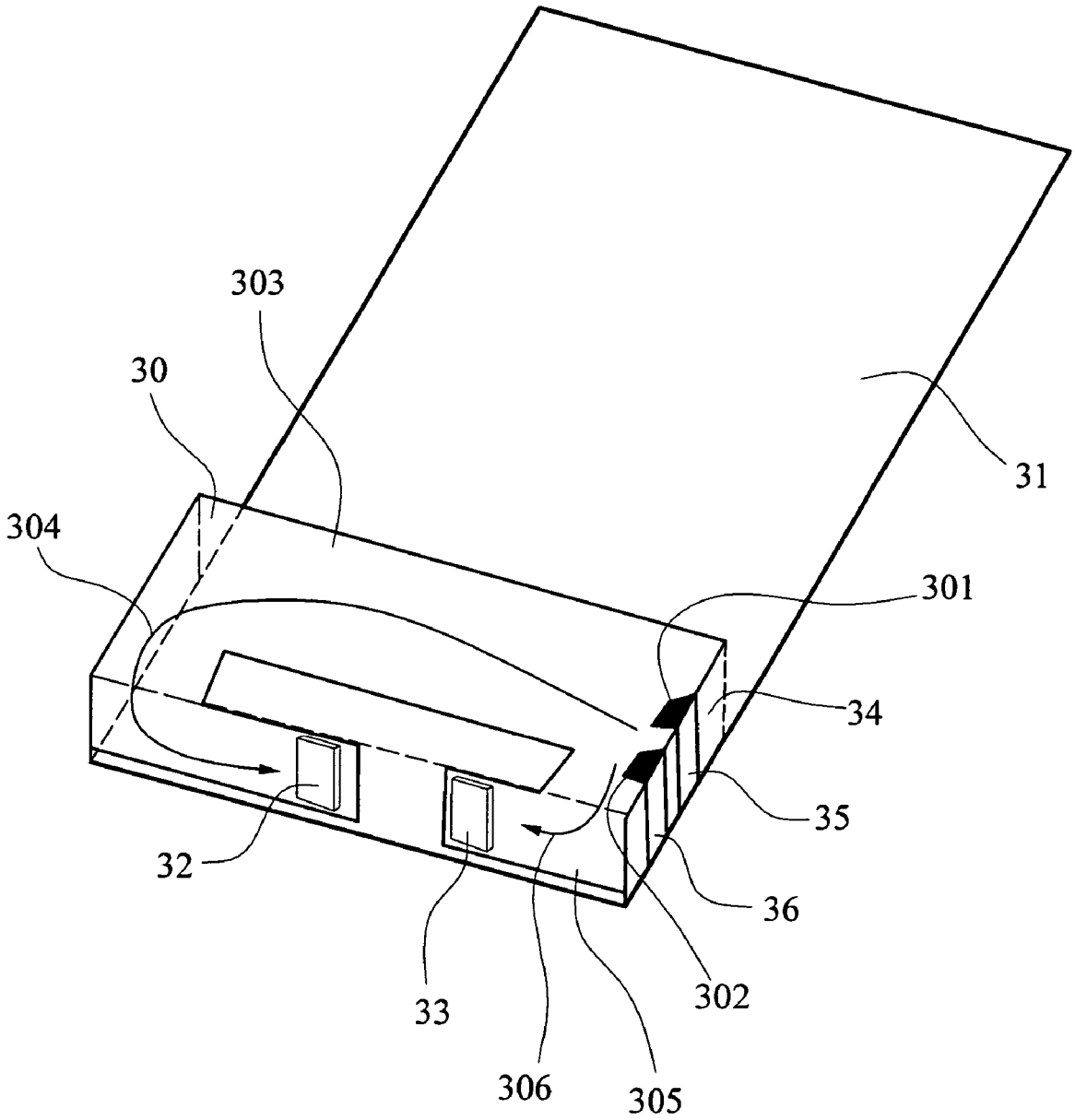
FIG. 3 schematically depicts a first preferred embodiment of PIFA according to the invention.

Referring to FIG. 3, a PIFA in accordance with a first preferred embodiment of the invention comprises a radiating member 30, a ground plane 31, a low frequency medium frequency regulator 32 having a dielectric constant in the range of 10 and 150 (preferably having a dielectric constant of 20), a high frequency medium frequency regulator 33 having a dielectric constant in the range of 10 and 150 (preferably having a dielectric constant of 20), a substrate 34, a feed member 35, and a shorting member 36. Each component is discussed in detailed below.

The radiating member 30 comprises a feed point 301, a shorting point 302, a first radiating element 303, and a second radiating element 305. The first radiating element 303 has a starting point proximate the feed point 301 and the shorting point 302, and a terminating point formed as an elongated coil so as to form a longer path 304 terminated at an outer edge of the ground plane 31. The terminating point is open so as to generate a resonance mode having a low frequency. The second radiating element 305 has a starting point connected to the starting point of the first radiating element 303, and a terminating point extended toward the terminating point of the first radiating element 303 to form a shorter path 306 terminated at the outer edge of the ground plane 31. The terminating point of the second radiating element 305 is proximate the terminating point of the first radiating element 303 so as to generate a resonance mode having a high frequency. The first radiating element 303 and the second radiating element 305 are located at two different planes in which the second radiating element 305 is at the outer edge of the ground plane 31 so as to generate a first operating mode in a low frequency and a second operating mode in a high frequency respectively. The feed point 301 and the shorting point 302 are located at the starting points of the first radiating element 303 and the second radiating element 305 respectively. The low frequency medium frequency regulator 32 and the high frequency medium frequency regulator 33 are added to the terminating points of the first radiating element 303 and the second radiating element 305 respectively so as to adjust a resonance frequency of the PIFA. Both the low frequency medium frequency regulator 32 and the high frequency medium frequency regulator 33 are perpendicular to the ground plane 31. The substrate 34 is implemented as a microwave dielectric member. One end of the feed member 35 is connected to the feed point 301 of the radiating member 30 and the other end thereof is connected to a signal source (not shown) for signal transmission. One end of the shorting member 36 is connected to the ground plane 31 and the other end thereof is connected to the shorting point 302 of the second radiating element 305.

Figure 4:
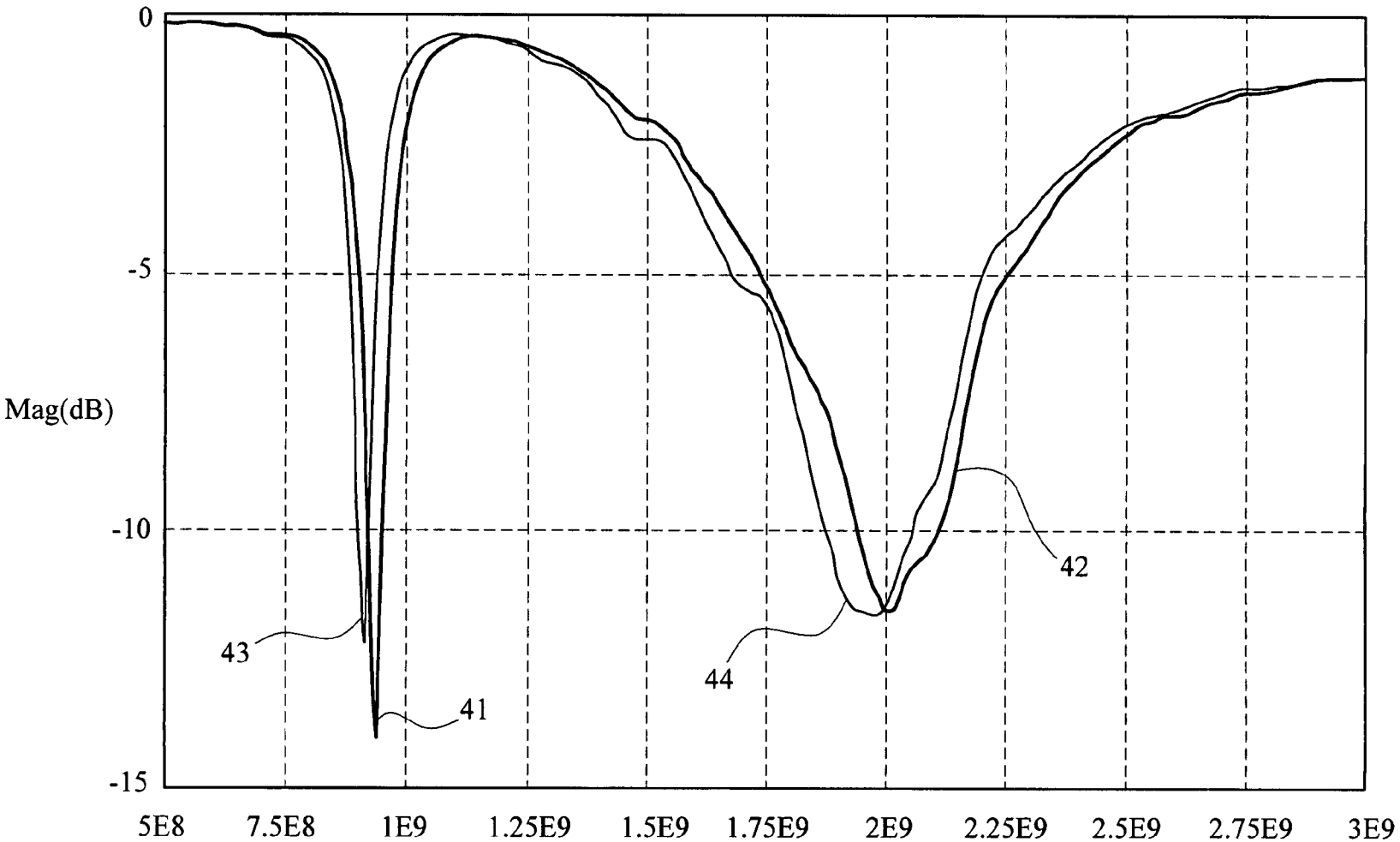
FIG. 4 is a graph of simulated return loss in dB against frequency in MHz for the PIFA of FIG. 3.

Referring to FIG. 4, it is a graph of simulated return loss in dB against frequency in MHz for the PIFA of the invention. Curve 41 represents the first operating mode in a low frequency of the PIFA. Curve 42 represents the second operating mode in a high frequency of the PIFA. The first operating mode has a center frequency of about 920 MHz. The second operating mode has a center frequency of about 1850 MHz. Impedance bandwidth is larger than 80 MHz for the first operating mode when VSWR (voltage to standing wave ratio) is 3.5:1. Impedance bandwidth is larger than 280 MHz for the second operating mode when VSWR is 3.5:1. As such, bandwidth requirements for GSM900, DCS1800, and PCS1900 can be satisfied. Curve 43 represents a frequency response result after changing a dielectric constant of the high frequency medium frequency regulator 33 to 36. Curve 44 represents a frequency response result after changing a dielectric constant of the low frequency medium frequency regulator 32 to 36. In view of the result, it is found that the resonance frequency of the first operating mode is decreased about 10 MHz and the resonance frequency of the second operating mode is decreased about 20 MHz respectively.

Figure 5:
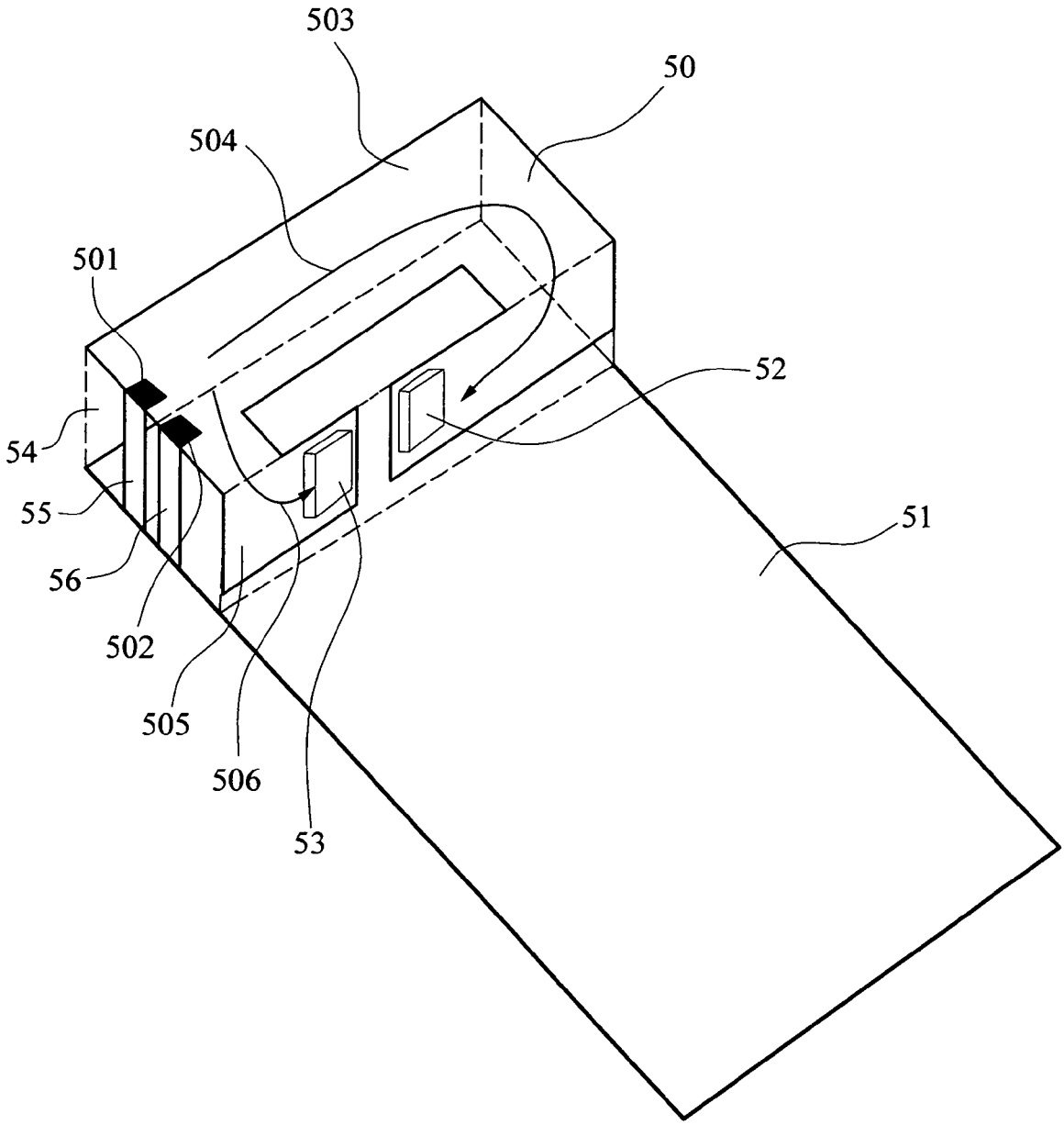
FIG. 5 schematically depicts a second preferred embodiment of PIFA according to the invention.

Referring to FIG. 5, a PIFA in accordance with a second preferred embodiment of the invention is shown. The PIFA comprises a radiating member 50, a ground plane 51, a low frequency medium frequency regulator 52 having a dielectric constant of 20, a high frequency medium frequency regulator 53 having a dielectric constant of 20, a substrate 54, a feed member 55, and a shorting member 56. Each component is discussed in detailed below.

The radiating member 50 comprises a feed point 501, a shorting point 502, a first radiating element 503, and a second radiating element 505. The first radiating element 503 is coiled to form a first path 504 terminated at an inner edge of the ground plane 51 and the second radiating element 505 is coiled to form a second path 506 terminated at the inner edge of the ground plane 51 respectively. The first radiating element 503 and the second radiating element 505 are located at two different planes in which the second radiating element 505 is at an inner edge of the ground plane 51 so as to generate a first operating mode in a low frequency and a second operating mode in a high frequency. The feed point 501 and the shorting point 502 are located at the starting points of the first radiating element 503 and the second radiating element 505 respectively. The low frequency medium frequency regulator 52 and the high frequency medium frequency regulator 53 are added to the terminating points of the first radiating element 503 and the second radiating element 505 respectively so as to adjust a resonance frequency of the PIFA.

While the invention herein disclosed has been described by means of specific embodiments, numerous modifications and variations could be made thereto by those skilled in the art without departing from the scope and spirit of the invention set forth in the claims.

What is claimed is:

1. A PIFA (planar inverted-F antenna) comprising:

a ground plane (31);

a radiating member (30) including a feed point (301), a shorting point (302), a first radiating element (303) having a first starting point proximate the feed point (301) and the shorting point (302), and a first terminating point coiled as a longer path (304) terminated at an outer edge of the ground plane (31) and being open for generating a first resonance mode having a low frequency, and a second radiating element (305) having a second starting point connected to the first starting point of the first radiating element (303), and a second terminating point extended toward the first terminating point of the first radiating element (303) to form a shorter path (306) terminated at the outer edge of the ground plane (31), the second terminating point of the second radiating element (305) being proximate the first terminating point of the first radiating element (303) for generating a second resonance mode having a high frequency;

a low frequency medium frequency regulator (32) located at the first terminating point of the first radiating element (303) and being perpendicular to the ground plane (31) for adjusting a resonance frequency of the first resonance mode having a low frequency;

a high frequency medium frequency regulator (33) located at the second terminating point of the second radiating element (305) and being perpendicular to the ground plane (31) for adjusting a resonance frequency of the second resonance mode having a high frequency;

a substrate (34);

a feed member (35) having one end connected to the feed point (301) of the radiating member (30) and the other end connected to a signal source for signal transmission; and a shorting member (36) having one end connected to the ground plane (31) and the other end connected to the shorting point (302) of the second radiating element (305).

2. The PIFA of claim 1, wherein the low frequency medium frequency regulator (32) has a dielectric constant in a range of 10 and 150.

3. The PIFA of claim 1, wherein the high frequency medium frequency regulator (33) has a dielectric constant in a range of (10) and (150).

4. The PIFA of claim 1, wherein the substrate (34) is a microwave dielectric member.

5. The PIFA of claim 1, wherein the first radiating element (303) and the second radiating element (305) are located at two different planes.

6. The PIFA of claim 5, wherein the second radiating element (305) is at the outer edge of the ground plane (31).

* * * * *